US006517985B2

(12) United States Patent
Takagi et al.

(10) Patent No.: US 6,517,985 B2
(45) Date of Patent: Feb. 11, 2003

(54) ELECTROPHOTOGRAPHIC DEVELOPER AND PROCESS FOR FORMING IMAGE

(75) Inventors: Masahiro Takagi, Minamiashigara (JP); Satoshi Inoue, Minamiashigara (JP); Kaori Ohishi, Minamiashigara (JP); Rieko Kataoka, Minamiashigara (JP); Fusako Kiyono, Minamiashigara (JP); Chiaki Suzuki, Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/000,302

(22) Filed: Dec. 4, 2001

(65) Prior Publication Data

US 2002/0115009 A1 Aug. 22, 2002

(30) Foreign Application Priority Data

Dec. 5, 2000 (JP) ..... 2000-369945
Dec. 18, 2000 (JP) ..... 2000-383510

(51) Int. Cl.[7] ..... G03G 9/08
(52) U.S. Cl. ..... 430/110.3; 430/45; 430/111.41; 430/125
(58) Field of Search ..... 430/110.3, 111.41, 430/110.4, 108.1, 125, 45

(56) References Cited

U.S. PATENT DOCUMENTS 6,013,404 A * 1/2000 Fung et al. ..... 430/111.41
6,150,062 A * 11/2000 Sugizaki et al. ..... 430/45

FOREIGN PATENT DOCUMENTS

| | | |
|---|---|---|
| JP | A 62-184469 | 8/1987 |
| JP | A 1-126670 | 5/1989 |
| JP | A 2-302772 | 12/1990 |
| JP | A 3-22979 | 3/1991 |
| JP | A 4-1773 | 1/1992 |
| JP | A 4-212190 | 8/1992 |
| JP | A 4-277754 | 10/1992 |
| JP | A 5-94113 | 4/1993 |
| JP | A 5-265360 | 10/1993 |
| JP | 6-148910 | 5/1994 |
| JP | A 8-254873 | 10/1996 |
| JP | A 11-133762 | 5/1999 |
| JP | A 2000-89502 | 3/2000 |
| JP | A 2000-122347 | 4/2000 |

* cited by examiner

*Primary Examiner*—John Goodrow
(74) *Attorney, Agent, or Firm*—Oliff & Berridge, PLC

(57) ABSTRACT

An electrophotographic developer is provided that attains improvement in reliability by improvement in cleaning property and reduction in wear of a photoreceptor in a well-balanced manner without impairing high transfer efficiency and high image quality of a spherical toner. The electrophotographic developer contains a toner and a carrier, the toner containing spherical colored particles having an average shape factor ($ML^2/A$) of about from 100 to 135 and irregular-shaped non-colored particles having a volume average particle diameter of about from 1 to 10 $\mu$m, a charge distribution of the developer having a peak value Q/Ma ascribable to the spherical colored particles and a peak value Q/Mb ascribable to the irregular-shaped non-colored particles, and the peak value Q/Ma and the peak value Q/Mb satisfying both the following formulae (1) and (2):

$$20\ \mu C/g \leqq |Q/Ma| \leqq 85\ \mu C/g \quad (1)$$

$$-0.7\ Q/Ma \leqq Q/Mb \leqq 0.5\ Q/Ma \quad (2).$$

18 Claims, No Drawings

ELECTROPHOTOGRAPHIC DEVELOPER AND PROCESS FOR FORMING IMAGE

BACKGROUND OF THE INVENTION

1. Field of the Invention

The present invention relates to a developer for using development of an electrostatic latent image in an electrophotographic process and an electrostatic recording process, and a process for forming an image.

2. Description of the Related Art

In the electrophotographic process, an electrostatic latent image formed on a latent image holding member (photoreceptor) is developed with a toner containing a colorant, and the resulting toner image is transferred to a transfer material and then fixed with a heat roll to obtain an image. The latent image holding member is separately subjected to cleaning for the formation of another electrostatic latent image. A dry developer used in the electrophotographic process is roughly classified to a one-component developer employing solely a toner formed by mixing a binder resin and a colorant, and a two-component developer formed by mixing a toner and a carrier. The one-component developer can is classified to a magnetic one-component developer using magnetic powder, which is transported by magnetic power for development, and a non-magnetic one-component developer using no magnetic powder, which is transported by application of charge with a charging roll for development. In the market of electrophotography in the last half of eighties, miniaturization and high performance are strongly demanded for digitalization, and particularly for a full color image, high image quality equivalent to sophisticated printing and silver halide photography is demanded.

Digital processing is essential for realizing high image quality, and the effect of the digital processing includes complicated image processing that can be carried out at high speed. According to the effect, characters and photographic images can be separately controlled, and reproducibility of qualities of them is greatly improved in comparison to the analog technology. In particular, it is important for photographic images that gradation correction and color correction become possible, it is advantageous in gradation characteristics, fineness, sharpness, color reproducibility and graininess in comparison to the analog technology. It is necessary that an image as an image output must be produced strictly reflecting a latent image produced by an optical system, and reduction in the particle diameter of toners is accelerated to aim for highly faithful reproducibility. However, it is difficult only by the reduction of the particle diameter of the toner that high image quality is stably obtained, and improvements of the basic characteristics in development, transferring, fixing and cleaning characteristics are becoming important. In particular, the reduction of the particle diameter of the toner increases the adhesion force thereof to be liable to cause deterioration of transferring performance, and therefore various techniques to handle a toner of a small particle diameter have been reported.

For example, the transfer property is improved by approaching the toner to a spherical shape (Japanese Patent Laid-Open No. 184469/1987). Although the transfer property is improved by making the toner spherical, cleaning failure occurs due to the non-transferred remaining toner that is slightly formed. As an inverted idea, a cleanerless system is proposed, in which a toner remaining on a photoreceptor drum (photoreceptor) is recovered by a developing device simultaneously with development to omit a cleaning system (Japanese Patent Laid-Open No. 302772/1990 and No. 94113/1993). In general, when the remaining toner is recovered simultaneously with development, the recovered toner has charging property that is different from the other toners, and problems occur in that the recovered toner is not developed but is accumulated in the developing device. Therefore, it becomes necessary that the transfer efficiency be further improved to control the toner amount to be recovered to a minimum value. Furthermore, even when the amount of the remaining toner can be minimum, the photoreceptor drum is contaminated with various substances, such as an external additive, paper powder and an ozonide product, and the toner may remain in a large amount on the photoreceptor drum when an accident, such as paper jam, occurs. Therefore, a cleaning system cannot be completely omitted because the substances and the toners cannot be completely recovered by the developing device, but some kinds of a cleaning system is necessary.

Various methods for cleaning a spherical toner have been proposed. In particular, a technique of cleaning by using a blade has been earnestly investigated. For example, it has been proposed that a spherical toner and an irregular-shaped toner be mixed under a predetermined condition, so as to compensate the poor cleaning property of the spherical toner by the irregular-shaped toner (Japanese Patent Publication No. 22979/1991). However, it is necessary in this method that at least 10% of the irregular-shaped toner is mixed with the spherical toner, and the excellent transfer performance and the high image quality of the spherical toner cannot be fully enjoyed.

It has also been proposed to add irregular-shaped particles containing magnetic powder to a developer (Japanese Patent Laid-Open No. 122347/2000). Although the cleaning performance is improved by the method, the image quality is deteriorated when the irregular-shaped particles are transferred, and the photoreceptor is damaged by the irregular-shaped particles containing magnetic powder. It is then proposed to add an aliphatic acid metallic salt to a toner (Japanese Patent Laid-Open No. 89502/2000). Although it is effective to reduce the frictional force at the nip part of the cleaning blade, the addition of the aliphatic acid metallic salt greatly decrease the charge amount of the toner, and as a result, fogging and scattering of the toner occurs on development to deteriorate the image quality.

It has been also proposed that after developing and transferring a spherical toner, the surface of a photoreceptor be developed with irregular-shaped particles, followed by cleaning the photoreceptor (Japanese Patent Laid-Open No. 126670/1989). However, this method requires a complicated system, and additional processes and additional members are necessary for supplying the irregular-shaped particles, so as to cause a problem from the standpoint of space saving of the machine.

Furthermore, it has been proposed that in a full color electrophotographic process, an irregular-shaped toner is used in one developing device of yellow, magenta, cyan and black, and spherical toners are used in the other developing devices, so as to improve the blade cleaning property (Japanese Patent Laid-Open No. 254873/1996). However, in the case where the same image is repeatedly output for a long period of time in this method, the irregular-shaped toner is non-uniformly supplied to the blade to cause a problem of cleaning failure in the part where the small amount of the irregular-shaped toner is developed.

It is also proposed that lubricating agent particles are added to the surface of a blade, so as to suppress the friction force at the nip part of the blade on the photoreceptor drum under the condition of intervening the non-transferred remaining toner to prevent the toner from scraping through (Japanese Patent Laid-Open No. 212190/1992). This method improves the cleaning property in the initial stage, but the lubricating agent particles on the surface of the blade is depleted for a long period to cause cleaning failure.

It is proposed to apply a direct current or alternating current bias voltage to a cleaning blade (Japanese Patent Laid-Open No. 265360/1993). However, because the charge amount of the non-transferred remaining toner varies depending on the charge amount of the developed toner, the transferring conditions, the environment of the case, and the sort of the image, cleaning cannot be completely carried out only by the application of the cleaning bias voltage. Furthermore, the cleaning bias voltage accelerates deterioration of the surface of the photoreceptor drum to decrease the service life of the photoreceptor.

It is also proposed to increase the contact pressure of the cleaning blade on the photoreceptor (Japanese Patent Laid-Open No. 1773/1992). This method greatly improves the cleaning performance in the initial stage, but when the material or the physical properties of the blade are not carefully considered, the blade is damaged to cause cleaning failure. Furthermore, as long as an organic photoreceptor is used as the photoreceptor drum, wearing of the photoreceptor drum is accelerated to induce formation of damages of the photoreceptor and reduction in service life of the photoreceptor.

As a solution from photoreceptors, it has been proposed that the unevenness on the surface of the photoreceptor is controlled (Japanese Patent Laid-Open No. 148910/1994). However, although cleaning can be carried out in the initial stage, the unevenness on the surface of the photoreceptor is changed over a long period of time, so as to cause cleaning failure. It has been also proposed to add fluorine series resin powder to the surface of the photoreceptor (Japanese Patent Laid-Open No. 27754/1992). The lubricating property of the surface of the photoreceptor is improved to reduce the friction force at the nip part of the cleaning blade, but the lubricating property is decreased associated with the progress of wearing of the photoreceptor over a long period, so as to finally cause cleaning failure.

As a solution from other systems, it has been proposed to provide a lubricating agent supplying unit is provided on a transferring path of a transfer material (Japanese Patent Laid-Open No. 133762/1999). Although the lubricating agent is supplied to the photoreceptor drum through the transfer material to improve the cleaning performance, the affinity between the toner and the transfer material is deteriorated due to the lubricating agent intervening between the transfer material and the transferring toner, so as to decrease the fixing performance.

As described in the foregoing, it is necessary for attaining high transfer efficiency that the toner particles are approximated to a spherical shape. From the standpoint of the cleaning mechanism, in the case where cleaning is carried out by using a blade, the non-transferred remaining toner forms a dam by banking up at the nip part of the blade to conduct cleaning, and the dam is separated in particle diameter, in which the particle diameter is decreased with approaching to the blade. While the particle diameter selectivity occurs at the nip part of the blade irrespective to the shape of the toner, the spherical toner suffers the closest arrangement at the nip part of the blade due to the uniform shape thereof, so as to increase the number of the toner contact points per a micro unit area of the surface of the photoreceptor at the nip part of the blade, and the friction forces of the respective particles of the toner are directed to the same direction. Accordingly, the total force received by the blade upon cleaning is increased, and as a result, the blade is pushed up or is damaged to cause cleaning failure by the toner scraping through. Other cleaning methods than that using the blade encounter the same phenomenon as long as the contamination substances on the surface of the photoreceptor are removed by scraping a matter on the surface of the photoreceptor.

Therefore, it is expected that the following conditions are necessary. In order to carry out cleaning of spherical particles (toner particles), the closest arrangement of the spherical particles is prevented by penetrating particles having higher irregularity than the spherical particles to the blade along with the non-transferred remaining spherical particles, whereby the pushing up force of the blade is suppressed. Irregular-shaped particles having a smaller particle diameter than the spherical particles are penetrated to the blade along with the non-transferred remaining spherical particles, so as to arrange, at the nip part of the blade, the irregular-shaped particles in the part nearer the blade edge than the spherical particles, whereby the blade through caused by rotation of the spherical particles is prevented.

However, as described in the foregoing, the combination use of the spherical toner and the irregular-shaped toner causes problems of difficulty in stable supply of the irregular-shaped toner and inhibition of the transfer property and the image quality of the spherical toner as a secondary discouragement of the irregular-shaped toner.

SUMMARY OF THE INVENTION

The invention has been made in view of the foregoing circumstances and is to provide an electrophotographic developer and a process for forming an image that attain improvement in reliability by improvement in cleaning property and reduction in wear of a photoreceptor in a well-balanced manner without impairing high transfer efficiency and high image quality of a spherical toner.

According to one aspect, the invention relates to an electrophotographic developer containing a toner and a carrier, the toner containing spherical colored particles having an average shape factor ($ML^2/A$) of about from 100 to 135 and irregular-shaped non-colored particles having a volume average particle diameter of about from 1 to 10 $\mu$m, a charge distribution of the developer having a peak value Q/Ma ascribable to the spherical colored particles and a peak value Q/Mb ascribable to the irregular-shaped non-colored particles, and the peak value Q/Ma and the peak value Q/Mb satisfying both the following formulae (1) and (2):

$$20\ \mu C/g \leqq |Q/Ma| \leqq 85\ \mu C/g \quad (1)$$

$$-0.7\ Q/Ma \leqq Q/Mb \leqq 0.5\ Q/Ma \quad (2)$$

According to another aspect, the invention relates to a process for forming an image containing the steps of: forming an electrostatic latent image on a latent image holding member; developing the latent image on the latent image holding member with a developer on a developer holding member to form a toner image; transferring the toner image to a recording material directly or indirectly; and removing a non-transferred remaining component by scraping the latent image holding member with a cleaning member. The toner image is a full color image formed by accumulating toner images of four colors of cyan, magenta, yellow and black, and at least one toner image of the toner images of four colors being developed with the above-described electrophotographic developer.

DETAILED DESCRIPTION OF THE INVENTION

Electrophotographic Developer

The electrophotographic developer of the invention contains at least a toner and a carrier, and the toner contains spherical colored particles having an average shape factor ($ML^2/A$) of about from 100 to 135 and irregular-shaped non-colored particles having a volume average particle diameter of about from 1 to 10 $\mu$m, and satisfies the charge conditions described later.

The electrophotographic developer of the invention contains the particular irregular-shaped non-colored particles are coexistent with the spherical colored particles as a toner, and satisfies the charge conditions, i.e., the charge distributions of the spherical colored particles and the irregular-shaped non-colored particles of the toner in the developer are separated from each other within the specified ranges as described later, whereby the charge property of the irregular-shaped non-colored particles is rendered low or inverse charge with respect to the spherical colored particles. Owing to the constitution, the electrophotographic developer exhibits the following functions. In the step of developing an electrostatic latent image, the irregular-shaped non-colored particles are developed as "fog" on a non-image part, and the spherical colored particles are developed in an image part. In the developing step, the spherical colored particles and the irregular-shaped non-colored particles are electrostatically separated. In the transfer step, the major part of the irregular-shaped non-colored particles is not transferred, but substantially all the spherical colored particles are transferred, whereby the non-transferred residue on the electrostatic latent image holding member (photoreceptor) has a high proportion of the irregular-shaped non-colored particles. When the non-transferred residue runs into the cleaning part, a dam is quickly formed with the irregular-shaped non-colored particles, and scraping through of the spherical colored particles is prevented. Since the non-image part is necessarily present in ordinary image output, in the invention, the irregular-shaped non-colored particles are stably supplied to the cleaning part through the development of the non-image part without causing supplying unevenness on the blade. Because the proportion of the irregular-shaped non-colored particles in the developer can be remarkably decreased, and the irregular-shaped non-colored particles are not mixed in the resulting image, the transfer property of the spherical colored particles and the image quality are not affected. Even when the irregular-shaped non-colored particles are transferred, the irregular-shaped non-colored particles are not recognized as "fog" since they contains no colorant. Because of the exhibition of these functions, improvement in reliability by improvement in cleaning property and reduction in wear of the photoreceptor can be realized in a well-balanced manner without impairing the high transfer property and the high image quality of the spherical toner.

In a system employed in some full color electrophotographic machines, in which image formation is carried out in plural steps in that black, yellow, magenta and cyan images are sequentially transferred from a photoreceptor to an intermediate transfer material, and then they are transferred at once to a medium, such as paper and an OHP sheet, a part of the irregular-shaped non-colored particles on the photoreceptor can be intentionally transferred to the intermediate transfer material by selecting the transfer conditions in order to improve the cleaning property of the intermediate transfer material. In this case, the color reproducibility and the image quality of the final image are not affected since the irregular-shaped non-colored particles contain no colorant.

The electrophotographic developer of the invention satisfies the following charge conditions. That is, it has a peak value Q/Ma ascribable to the spherical colored particles and a peak value Q/Mb ascribable to the irregular-shaped non-colored particles, and the peak value Q/Ma and the peak value Q/Mb satisfy both the following formulae (1) and (2):

$$20\ \mu C/g \leqq |Q/Ma| \leqq 85\ \mu C/g \quad (1)$$

$$-0.7\ Q/Ma \leqq Q/Mb \leqq 0.5\ Q/Ma \quad (2)$$

As shown in the formula (1), the electrophotographic photoreceptor has an absolute value of the peak value Q/Ma ascribable to the spherical colored particles is in a range of about from 20 to 85 $\mu$C/g, and it is preferably about from 30 to 70 $\mu$C/g, and more preferably from 35 to 65 $\mu$C/g. When Q/Ma is lower than 20 $\mu$C/g, the electrostatic adhering force of the spherical colored particles is too low to cause contamination inside the machine and image fogging upon development. When Q/Ma exceeds 85 $\mu$C/g, on the other hand, sufficient developing property cannot be obtained to cause shortage in image density. In the case where an organic photoreceptor is used as the electrostatic image holding member, and the latent image on the image part is formed by exposure with laser light, the polarity of Q/Ma is generally negative.

As shown in the formula (2), the peak value Q/Mb ascribable to the irregular-shaped non-colored particles is in a range of about from −0.7 Q/Ma to 0.5 Q/Ma, and it is preferably about from −0.60 Q/Ma to 0.45 Q/Ma, and more preferably from −0.50 Q/Ma to 0.40 Q/Ma. When Q/Mb is more negative than −0.7 Q/Ma, i.e., it has the charge peak toward an inverse polarity direction by more than −0.7 Q/Ma with respect to the spherical colored particles, the development of the irregular-shaped non-colored particles on the non-image part becomes insufficient to cause shortage in supply of the irregular-shaped non-colored particles to the cleaning part, whereby there is a serious danger of causing cleaning failure. When Q/Mb is more positive than 0.5 Q/Ma, i.e., it has the charge peak toward an equal polarity direction by more than 0.5 Q/Ma with respect to the spherical colored particles, the irregular-shaped non-colored particles are developed only on the image part to cause unevenness in supply of the irregular-shaped non-colored particles to the cleaning part, whereby local cleaning failure and damages of the photoreceptor occur.

In the electrophotographic developer of the invention, specific methods for controlling the relationship of Q/Ma and Q/Mb within the ranges specified in the foregoing are not particularly limited, and the following methods can be exemplified. In the case where the spherical colored particles are a negative charge toner, a resin having a friction electrostatic charge capability that is lower than a binder resin used in the spherical colored particles is used as the main component of the irregular-shaped non-colored particles. (For example, polyester is used in the spherical colored particles, and a styrene-acrylate copolymer is used in the irregular-shaped non-colored particles, so as to render the negative charge property of the spherical colored particles relatively strong.) A positive charge controlling agent is added to the irregular-shaped non-colored particles. The external additive compositions of the spherical colored particles and the irregular-shaped non-colored particles are differentiated. In the case where the spherical colored particles and the irregular-shaped non-colored particles are constituted with the same binder resin, a coloring material having higher negative charge property is added to the spherical colored particles, or in alternative, a negative charge controlling agent is added to the spherical colored particles. These methods may be used in combination.

The measurement of the charge amount distribution can be carried out in the following manner. Examples of the method for discriminating the charge peaks of the spherical colored particles and the irregular-shaped non-colored particles include such a method that the track of the toner measured by a charge spectrography is subjected to image analysis to obtain the Q/M distribution, and at the same time, evaluation of the shapes of the respective particles is carried out. The discrimination can also be conducted by another method in that when the Q/M distribution is obtained by utilizing the difference in particle size distributions of the spherical colored particles and the irregular-shaped non-colored particles with a charge amount distribution measuring apparatus, such as "E-Spart Analyzer" produced by Hosokawamicron Corp., the particle size distributions of the particles constituting the respective charge peaks are analyzed. The peak value Q/Ma ascribable to the spherical colored particles and the peak value Q/Mb ascribable to the irregular-shaped non-colored particles can be obtained by these methods for measuring the charge amount distribution.

In the electrophotographic developer of the invention, it is preferred from the standpoint of improvement in cleaning property that the average particle diameter Da of the spherical colored particles and the average particle diameter Db of the irregular-shaped non-colored particles satisfy the following formula (3):

$$0.1\ Da \leqq Db \leqq Da \tag{3}$$

As shown in the formula (3), in the electrophotographic developer of the invention, the average particle diameter of the irregular-shaped non-colored particles Db is preferably in a range of about from 0.1 Da to Da, and it is more preferably about from 0.20 Da to 0.85 Da, and further preferably from 0.35 Da to 0.80 Da. In the case where the irregular-shaped non-colored particles have an average particle diameter Db that is larger than that of the spherical colored particles, there are some cases where it becomes difficult to form a dam of the irregular-shaped non-colored particles for preventing the scraping through of the spherical colored particles in the cleaning part, so as to impair the cleaning reliability. In the case where the average particle diameter Db of the irregular-shaped non-colored particles is smaller than 0.1 Da, there are some cases where such a state is liable to occur that the irregular-shaped non-colored particles are attached to the surface of the spherical colored particles to inhibit independent behavior thereof, so as to cause decrease in image quality and decrease in cleaning performance.

In the electrophotographic developer of the invention, the mixing ratio by weight of the spherical colored particles and the irregular-shaped non-colored particles (spherical colored particles/irregular-shaped non-colored particles) is preferably in a range of about from 100/0.1 to 100/2.0, and it is more preferably from 100/0.2 to 100/1.5, and further preferably from 100/0.3 to 100/1.0. The proportion of the irregular-shaped non-colored particles is smaller than 100/0.1, there are some cases where supply of the irregular-shaped non-colored particles to the cleaning part is in short to cause a problem in maintenance of the cleaning property. When the proportion of the irregular-shaped non-colored particles is more than 100/2.0, on the other hand, it is not preferred since there are some cases where development of the irregular-shaped non-colored particles on the non-image part becomes excessive to cause contamination inside the machine.

In the electrophotographic developer of the invention, the toner contains the spherical colored particles having an average shape factor ($ML^2/A$) of about from 100 to 135 and the irregular-shaped non-colored particles having an average particle diameter of about from 1 to 10 $\mu$m, both of which satisfy the foregoing charge conditions, and the respective particles will be described in detail below.

The irregular-shaped non-colored particles will be described.

The irregular-shaped non-colored particles preferably have an average particle diameter of from 1 to 10 $\mu$m, and more preferably from 2 to 7 $\mu$m. When the average particle diameter is less than 1 $\mu$m, there are some cases where the irregular-shaped non-colored particles are fused on the surface of the carrier to deteriorate the charge property of the developer. When it exceeds 10 $\mu$m, on the other hand, there are some cases where the irregular-shaped non-colored particles cause contamination inside the machine.

The irregular-shaped non-colored particles preferably have an average shape factor ($ML^2/A$) of about from 135 to 150, and more preferably from 135 to 145. When it is less than 135, there are some cases where the cleaning performance is deteriorated. When it exceeds 150, on the other hand, breakage of the particles occurs inside the machine, and thus reduction in charge property due to contamination of the carrier and cleaning failure due to insufficient formation of the dam are induced.

The irregular-shaped non-colored particles may contain either an inorganic material or an organic material as a main component, and it is preferred that an organic material is contained as a main component. In the case where an inorganic material is contained as a main component, many inorganic materials have a larger specific gravity than organic particles, and it is not preferred in such cases because it is difficult to stably develop them on the photoreceptor, and wear of the photoreceptor and deterioration of the cleaning member are accelerated owing to their high hardness. The organic materials is not particularly limited, and examples thereof include a homopolymer and a copolymer of a styrene compound, such as styrene and chlorostyrene; a monoolefin compound, such as ethylene, propylene, butylene and isoprene; a vinyl ester compound, such as, vinyl propionate, vinyl benzoate and vinyl acetate; an α-methylene aliphatic monocarboxylate, such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; a vinyl ether, such as vinyl ethyl ether and vinyl butyl ether; and a vinyl ketone, such as vinyl methyl ketone, vinyl hexyl ketone and vinyl isopropenyl ketone. In particular, representative examples of the resin include a polystyrene resin, a polyester resin, a styrene-alkyl acrylate copolymer, a styrene-alkyl methacrylate copolymer, a styrene-acrylonitrile copolymer, a styrene-butadiene copolymer, a styrene-maleic anhydride copolymer, a polyethylene resin and a polypropylene resin. Furthermore, a polyurethane resin, an epoxy resin, a silicone resin, a polyamide resin and modified rosin can also be exemplified.

The irregular-shaped non-colored particles may be internally added or externally added with known additives, such as a charge controlling agent, a lubricating agent (wax) and inorganic fine particles.

Examples of the lubricating agent include a solid lubricating agent, such as graphite, molybdenum disulfide, a fatty acid and a metallic salt of a fatty acid; a low molecular weight polyolefin, such as polypropylene, polyethylene and polybutene; a silicone having a softening point upon heating; an aliphatic amide, such as oleic amide, erucic amide, recinoleic amide and stearic amide; vegetable wax, such as carnauba wax, rice wax, candelilla wax, wood wax and jojoba oil; animal wax, such as yellow beeswax; mineral or petroleum wax, such as montan wax, ozokerite, ceresin, paraffin wax, microcrystalline wax and Fischer-Tropsch wax; and modified products thereof. These may be used singly or in combination of two or more of them.

The inorganic fine particles are not particularly limited, and examples thereof include silica, titanium oxide, metatitanic acid, alumina, zinc oxide, zirconia, magnesia, calcium carbonate and magnesium carbonate. Silica, titanium oxide and metatitanic acid are frequently used. These may be used singly or in combination of two or more of them.

The process for producing the irregular-shaped non-colored particles is not particularly limited, and examples thereof include a process, in which one organic material or a mixture of plural organic materials is subjected to pulverization and classification; a process, in which mother particles and daughter particles are previously formed, and they are hybridized by a dry process, such as mixing in a Henschel mixer and a mechanochemical reaction by a hybridization system or a mechanofusion system; and a process, in which mother particles and daughter particles are hybridized by a wet process, such as mixing, aggregation and heat fusion. Furthermore, a known process may be employed as a process for adding the additives, and for example, they may be added by a dry process using a Henschel mixer or by heat fusion through a wet process. It is also possible as described later that the irregular-shaped non-colored particles are added upon external addition of inorganic fine particles to the spherical colored particles, whereby the same additive as that adhered on the surface of the spherical colored particles is adhered on the surface of the irregular-shaped non-colored particles. It is further possible that the irregular-shaped non-colored particles are added to the spherical colored particles having an additive added thereto or to the developer, so as to transfer a part of the additive on the surface of the spherical colored particle to the surface of the irregular-shaped non-colored particles.

The spherical colored particles will be described.

The spherical colored particles have an average shape factor ($ML^2/A$) of about from 100 to 135, and it is necessary for realizing high transfer efficiency that the shape is approximated to a sphere. The average shape factor is preferably from 100 to 125. When the average shape factor ($ML^2/A$) exceeds 135, the transfer efficiency is lowered, and deterioration in image quality of a printed sample can be confirmed by the naked eye.

The spherical colored particles contain at least a binder resin and a colorant, and may have a particle diameter of from 2 to 12 $\mu$m, and preferably from 3 to 9 $\mu$m.

Examples of the binder resin include a homopolymer and a copolymer of a styrene compound, such as styrene and chlorostyrene; a monoolefin compound, such as ethylene, propylene, butylene and isoprene; a vinyl ester compound, such as vinyl acetate, vinyl propionate, vinyl benzoate and vinyl acetate; an a-methylene aliphatic monocarboxylate, such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate; a vinyl ether, such as vinyl methyl ether, vinyl ethyl ether and vinyl butyl ether; and a vinyl ketone, such as vinyl methyl ketone, vinyl hexyl ketone and vinyl isopropenyl ketone. In particular, representative examples of the resin include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene and polypropylene. Furthermore, polyester, polyurethane, an epoxy resin, a silicone resin, a polyamide resin, modified rosin and paraffin wax can also be exemplified.

Representative examples of the colorant include magnetic powder, such as magnetite and ferrite, carbon black, Aniline Blue, Calco Oil Blue, Chrome Yellow, Ultramarine Blue, Du Pont Oil Red, Quinoline Yellow, Methylene Blue Chloride, Phthalocyanine Blue, Malachite Green Oxalate, Lamp Black, Rose Bengal, C.I. Pigment Red 48:1, C.I. Pigment Red 122, C.I. Pigment Red 57:1, C.I. Pigment Yellow 97, C.I. Pigment Yellow 17, C.I. Pigment Blue 15:1 and C.I. Pigment Blue 15:3.

To the spherical colored particles, known additives, such as a charge controlling agent, a lubricating agent (wax) and inorganic fine particles, may be internally added or externally added.

Representative examples of the releasing agent (wax) include low molecular weight polyethylene, low molecular weight polypropylene, Fischer-Tropsch wax, montan wax, carnauba wax, rice wax and candelilla wax.

As the charge controlling agent, known ones can be employed, and an azo series metallic complex compound, a metallic complex compound of salicylic acid and a resin type charge controlling agent having a polar group. In the case where the toner is produced by a wet process, a material that is difficult to be dissolved in water is preferably used from the standpoint of ion intensity and reduction of pollution caused by waste water.

As the inorganic fine particles, inorganic fine particles of a smaller diameter having a primary particle diameter of 40 nm or less may be used for improving powder flowability and charge control, and depending on necessity, inorganic or organic fine particles having a larger particle diameter than them can be used for decreasing the adhesion strength. Known materials may be used as the inorganic fine particles. Examples thereof include silica, alumina, titania, metatitanic acid, zinc oxide, zirconia, magnesia, calcium carbonate, magnesium carbonate, calcium phosphate, cerium oxide and strontium titanate. The inorganic fine particles of a smaller diameter may be subjected to a surface treatment to increase dispersibility, whereby such an effect is obtained that the powder flowability is improved.

The process for producing the spherical colored particles is not particularly limited as far as they satisfy the shape factor within the foregoing range, and known processes may be employed. Specifically, the following processes can be exemplified. In a kneading and pulverization process, a binder resin and a colorant, as well as, depending on necessity, a releasing agent and a charge controlling agent, are subjected to kneading, pulverization and classification. Particles obtained by the kneading and pulverization process are subjected to change in shape by a mechanical impact force or heat energy. In an emulsion polymerization and aggregation process, a polymerizable monomer of a binder resin is emulsion-polymerized, and the resulting dispersion is mixed with a dispersion of a colorant and, depending on necessity, a releasing agent and a charge controlling agent, followed by aggregation and heat fusion, whereby the spherical colored particles are obtained. In a suspension polymerization process, a solution of a polymerizable monomer for obtaining a binder resin and a colorant, as well as depending on necessity, a releasing agent and a charge controlling agent, is suspended in an aqueous medium, followed by polymerization. In a dissolution and suspension process, a solution of a binder resin and a colorant, as well as depending on necessity, a releasing agent and a charge controlling agent, is suspended in an aqueous medium, followed by granulation. Furthermore, another production process is possible in that the spherical colored particles obtained by the foregoing processes are used as a core, and aggregating particles are adhered thereto and subjected to heat fusion to form a core-shell structure. In the case where an external additive is added, the production can be effected by mixing the spherical colored particles and the external additive in a Henschel mixer or a V-blender. In the case where the spherical colored particles are produced by a wet process, the external additive may be added through a wet process.

In the electrophotographic developer of the invention, it is preferred that white or pale yellow spherical inorganic fine particles are further mixed and adhered (external addition) to the surface of at least one of the spherical colored particles and the irregular-shaped non-colored particles from the standpoint of further improvement of the cleaning property. While the mechanism of the improvement of the cleaning property is completely clear, in the case of the blade cleaning, for example, it is expected that the spherical inorganic fine particles are released from the surface of the toner by the contact pressure force of the blade, so as to exhibit a function like a lubricating agent in the vicinity of the contact part of the blade and the photoreceptor, whereby micro vibration of the blade is prevented, and thus the scraping through of the toner can be prevented even when the blade is used under a low linear pressure. Furthermore, in the case where the spherical inorganic fine particles are mixed and adhered to the spherical colored particles, another advantage can be obtained in that the transfer maintaining property of the spherical colored particle can be further improved. The external addition treatment of the spherical inorganic fine particles can be carried out in the same manner as described in the foregoing.

The spherical inorganic fine particles preferably have an average particle diameter of about from 80 to 300 nm from the standpoint of improvement of the cleaning property, and more preferably from 100 to 200 nm.

Preferred examples of the spherical inorganic fine particles include spherical monodisperse silica. As the spherical monodisperse silica, those obtained by a sol-gel process as a wet process are preferred. The dispersibility can be further adjusted by controlling the species of a hydrophobic treatment agent or the treating amount thereof upon a hydrophobic treating step in the sol-gel process. The volume average particle diameter can be freely controlled by the weight ratios of an alkoxy silane, ammonia, an alcohol and water, the reaction temperature, the agitation rate and the supplying rate in the hydrolysis and polycondensation steps in the sol-gel process. The monodisperse and the spherical shape can be realized by the production according to the process.

Specifically, the following process, for example, can be employed. Tetramethoxysilane is dropped and agitated in the presence of water and an alcohol with aqueous ammonia as a catalyst under heating. A silica sol suspension thus obtained through the reaction is subjected to centrifugal separation to separate into wet silica gel, an alcohol and aqueous ammonia. A solvent is added to the wet silica gel to again form silica sol, to which a hydrophobic treatment agent is added to render the surface of the silica hydrophobic. As the hydrophobic treatment agent, general silane compounds may be used. The solvent is removed from the silica sol having been subjected to the hydrophobic treatment, followed by drying and sieving, to obtain the target monodisperse silica. The silica thus obtained may further be subjected to the treatment.

As silane compound used as the hydrophobic treatment agent, water soluble ones are preferably used. Examples of the silane compound include a compound represented by the chemical formula $R_aSiX_{4-a}$ (wherein a represents an integer of from 0 to 3; R represents a hydrogen atom or an organic group, such as an alkyl group and an alkenyl group; and X represents a hydrolytic group, such as a chlorine atom, a methoxy group and an ethoxy group), and any type of chlorosilane, alkoxysilane, silazane and a special silylation agent can be employed. Specific examples thereof include methyltrichlorosilane, dimethyldichlorosilane, trimethylchlorosilane, phenyltrichlorosilane, diphenyldichlorosilane, tetramethoxysilane, methyltrimethoxysilane, dimethyldimethoxysilane, phenyltrimethoxysilane, diphenyldimethoxysilane, tetraethoxysilane, methyltriethoxysilane, dimethyldiethoxysilane, phenyltriethoxysilane, diphenyldiethoxysilane, isobutyltrimethoxysilane, decyltrimethoxysilane, hexamethyldisilazane, N,O-(bistrimethylsilyl)acetamide, N,N-bis(trimethyl)urea, tert-butyldimethylchlorosilane, vinyltrichlorosilane, vinyltrimethoxysilane, vinyltriethoxysilane, γ-methacryloxypropyltrimethoxysilane, β-(3,4-epoxycyclohexyl)ethyltrimethoxysilane, γ-glycidoxypropyltrimethoxysilane, γ-glycidoxypropylmethyldiethoxysilane, γ-mercaptopropyltrimethoxysilane and γ-chloropropyltrimethoxysilane. Particularly preferred examples of the treating agent include dimethyldimethoxysilane, hexamethyldisilazane, methyltrimethoxysilane, isobutyltrimethoxysilane and decyltrimethoxysilane.

In the electrophotographic developer of the invention, the toner is obtained by mixing the spherical colored particles and the irregular-shaped non-colored particles, and the method for mixing is not particularly limited and can be effected in the similar manner as the external addition treatment of the particles described in the foregoing. Furthermore, depending on necessity, a known cleaning assisting material may be mixed and added in addition to the irregular-shaped non-colored particle having the foregoing constitution.

The electrophotographic developer of the invention is used after mixing the toner and a carrier, and examples of the carrier include iron powder, glass beads, ferrite powder, nickel powder and those obtained by coating a resin thereon. The mixing ratio to the carrier may be appropriately selected.

Process for Forming Image

The process for forming an image according to the invention contains at least a latent image forming step of forming the latent image on a latent image holding member (photoreceptor); a developing step of developing the latent image on the latent image holding member with a developer on a developer holding member; a transferring step of transferring a developed toner image to a recording material directly or indirectly; and a cleaning step of removing a non-transferred remaining component by scraping the latent image holding member with a cleaning member, the developing step being to form the toner images using the toners of four colors of cyan, magenta, yellow and black, and at least one toner image is developed with the developer according to the invention. In the apparatus for forming an image according to the invention, improvement in reliability by improvement in cleaning property and reduction in wear of a photoreceptor can be attained in a well-balanced manner without impairing high transfer efficiency and high image quality of the spherical toner.

In the process for forming an image of the invention, the respective steps can be carried out in the manners that are conventionally known, and it is preferred in the developing step that the irregular-shaped non-colored particles in the toner are selectively developed on the non-image part. The selective development can be carried out, for example, in such a manner that the difference between the potential at the image part on the latent image holding member and the development bias voltage, and the frequency and the perk-to-perk component of the alternating current component overlaid on the development bias are adjusted within such a range that the development performance of the colored particles are not impaired.

In the cleaning step, it is specifically preferred that the non-transferred remaining component is removed by scraping by using a blade (for example, a rubber blade of polyurethane). It is not particularly limited to a blade as far as the non-transferred remaining component can be removed by scraping the latent image holding member.

EXAMPLE

The invention will be described in more detail with reference to the following examples, but the invention is not construed as being limited thereto. All "parts" in the following description are "parts by weight" unless otherwise indicated.

The measurements in the examples are carried out in the following manners.

Particle Size Distribution (Average Particle Diameter)

Measurement is conducted by using Multisizer (produced by Nikkaki Co., Ltd.) with an aperture diameter of 100 $\mu$m.

Average Shape Factor $ML^2/A$

The value is obtained by calculation through the following formula:

$$ML^2/A=(\text{maximum length})^2\cdot\pi\cdot100/(\text{area}\cdot4)$$

In the case of a true sphere, $ML^2/A=100$. As a specific method for obtaining the average shape factor, a toner image is grabbed from an optical microscope to an image analyzer (LUZEX III, produced by Nireco Corp.) to measure a circle-equivalent diameter, and the values of $ML^2/A$ of the respective particles are obtained from the maximum length and the area through the foregoing formula.

Charge Amount

The Q/M distribution is measured by E-spart Analyzer produced by Hosokawa Micron Corp., and particle size analysis of the charged particles constituting the respective charge peaks is carried out, whereby the particles constituting the respective charge peaks are identified.

Image Density

The image density is measured by using X-Rite 404A.

Production of Spherical Colored Particles A

Preparation of Resin Fine Particle Dispersion 370 g of styrene, 30 g of n-butyl acrylate, 8 g of acrylic acid, 24 g of dodecanethiol and 4 g of carbon tetrabromide are mixed and dissolved, and the solution is emulsion-polymerized in a solution formed by dissolving 6 g of a nonionic surface active agent (Nonipole 400, produced by Sanyo Chemicals Co., Ltd.) and 10 g of an anionic surface active agent (Neogen SC, produced by Daiichi Kogyo Seiyaku Co., Ltd.) in 550 g of ion exchanged water in a flask, to which 50 g of ion exchanged water having 4 g of ammonium persulfate dissolved therein is added over 10 minutes under slowly mixing. After replacing with nitrogen, the content of the flask is heated to 70° C. over an oil bath, and the emulsion polymerization is continued for 5 hours. As a result, a resin fine particle dispersion having an average particle diameter of 150 nm, a glass transition point Tg of 58° C. and a weight average molecular weight Mw of 11,500 is obtained. The solid content of the dispersion is 40% by weight.

Preparation of Colorant Dispersion

| | |
|---|---|
| Cyan pigment B15:3 | 60 g |
| Nonionic surface active agent (Nonipole 400, produced by Sanyo Chemicals Co., Ltd.) | 5 g |
| Ion exchanged water | 240 g |

The foregoing components are mixed and dissolved, and the mixture is agitated by a homogenizer (Ultra-Turrax T50, produced by IKA Japan Co., Ltd.) for 10 minutes, and thereafter it is subjected to a dispersion treatment by an altimizer, so as to prepare a colorant dispersion having colorant (cyan pigment) particles having an average particle diameter of 250 nm dispersed therein.

Preparation of Releasing Agent Dispersion

| | |
|---|---|
| Paraffin wax (HNP0190, produced by Nippon Seiro Co., Ltd., melting point: 85° C.) | 100 g |
| Cationic surface active agent (Sanisol B50, produced by Kao Corp.) | 5 g |
| Ion exchanged water | 240 g |

The foregoing components are mixed and dispersed in a stainless steel round flask by a homogenizer (Ultra-Turrax T50, produced by IKA Japan Co., Ltd.) for 10 minutes, and thereafter it is subjected to a dispersion treatment by a pressure discharge type homogenizer, so as to prepare a wax dispersion having wax particles having an average particle diameter of 550 nm dispersed therein.

Preparation of Aggregated Particles

| | |
|---|---|
| Resin fine particle dispersion | 234 parts |
| Colorant dispersion | 30 parts |
| Releasing agent dispersion | 40 parts |
| Polyaluminum chloride (PAC 100W, produced by Asada Chemical Industries, Ltd.) | 1.8 parts |
| Ion exchanged water | 600 parts |

The foregoing components are mixed and dispersed in a stainless steel round flask by a homogenizer (Ultra-Turrax T50, produced by IKA Japan Co., Ltd.), and thereafter it is heated to 55° C. over a heating oil bath under stirring the contents of the flask. After maintaining at 55° C. for 30 minutes, formation of aggregated particles having a D50 value of 4.8 μm is confirmed. Furthermore, it is maintained at 56° C. for 2 hours by increasing the temperature of the heating oil bath, so as to obtain a D50 value of 5.9 μm. Thereafter, 32 parts by weight of the resin fine particle diapason is added to the dispersion containing the aggregated particles, and the temperature of the heating oil bath is increased to 55° C., followed by maintaining for 30 minutes. A 1N sodium hydroxide solution is added to the dispersion containing the aggregated particles to adjust the pH of the system to 5.0. Thereafter, the stainless steel flask is sealed, and the contents of the flask is heated to 95° C. under continued stirring using a magnetic seal, followed by maintaining for 6 hours. After cooling, the resulting toner mother particles are filtered off and washed with ion exchanged water four times, followed by subjecting to freeze drying, so as to obtain colored particles. The aggregated particles have a D50 value of 6.2 μm and an average shape factor $ML^2/A$ of 117.

External Addition Treatment

To 100 parts of the aggregated particles, 0.8 part of rutile titanium oxide (particle diameter: 20 nm, n-decyltrimethoxysilane treatment) and 1.8 parts of spherical monodisperse silica (silica sol obtained by a sol-gel process is subjected to an HMDS treatment, and then subjected to drying and pulverization, Wadell conglobation degree Ψ: 0.92, particle diameter D50: 137 nm, particle size standard deviation: 25 nm) are blended in a Henschel mixer at a peripheral speed of 30 m/s for 15 minutes, and coarse particles are removed by using a sieve of 45 μm-mesh, so as to obtain spherical colored particles A.

Production of Spherical Colored Particles B

The same aggregated particles as in the spherical colored particles A are used. To 100 parts of the aggregated particles, 1 part of a compound obtained by treating metatitanic acid with isobutylsilane (D50: 30 nm), 1.2 parts of silica formed by a gas phase oxidation process (particle diameter: 40 nm, silicone oil treatment) and 1.3 parts of spherical monodisperse silica (silica sol obtained by a sol-gel process is subjected to an HMDS treatment, and then subjected to drying and pulverization, Wadell conglobation degree Ψ: 0.95, particle diameter D50: 120 nm, particle size standard deviation: 22 nm) are blended in a Henschel mixer at a peripheral speed of 30 m/s for 15 minutes, and coarse particles are removed by using a sieve of 45 μm-mesh, so as to obtain spherical colored particles B.

Production of Spherical Colored Particles C

Preparation of Pigment Dispersion

| | |
|---|---|
| Polyester resin (Tg: 60° C., softening point: 98° C., weight average molecular weight: 9,500) | 50 parts |
| Magenta pigment (C.I. Pigment Red 57) | 50 parts |
| Ethyl acetate | 100 parts |

Glass beads are added to a dispersion of the foregoing components and set in a sand mill disperser. The dispersion is dispersed for 3 hours in a high speed agitation mode under cooling from the periphery of the disperser, and then diluted with ethyl acetate, so as to prepare a pigment dispersion having a pigment concentration of 15% by weight.

Preparation of Fine Particulate Wax

| | |
|---|---|
| Paraffin wax (melting point: 85° C.) | 15 parts |
| Toluene | 85 parts |

The foregoing materials are put in a disperser having agitation blades and a function of circulating a heat medium around the vessel. The temperature is gradually increased under agitating at 83 rotations per minute, and finally it is maintained at 100° C. for 3 hours under agitation. While continuing the agitation, it is cooled at a rate of 2° C. per minute to room temperature, so as to deposit fine particulate wax. The wax dispersion is again subjected to dispersion by using a high pressure emulsifier, APV Gaulin Homogenizer 15MR, at a pressure of 550 $kg/cm^2$. The particle size of the wax is measured in the similar manner, and it is 0.69 μm. The fine particulate wax dispersion thus produced is diluted with ethyl acetate to adjust the weight concentration of the wax to 15% by weight.

Preparation of Oily Phase

| | |
|---|---|
| Polyester resin (Tg: 60° C., softening point: 98° C., weight average molecular weight: 9,500) | 85 parts |
| Pigment dispersion (pigment concentration: 15% by weight) | 50 parts |
| Fine particulate wax dispersion (wax concentration: 15% by weight) | 33 parts |
| Ethyl acetate | 32 parts |

An oily phase of the foregoing composition is prepared after confirming that a polyester resin is sufficiently dissolved therein. The oily phase is put in a homomixer (Ace Homogenizer, produced by Nippon Seiki Co., Ltd.) and agitated at 16,000 rotations per minute for 2 minutes, so as to prepare a uniform oily phase.

Preparation of Aqueous Phase

| | |
|---|---|
| Calcium carbonate (average particle diameter: 0.03 μm) | 60 parts |
| Pure water | 40 parts |

A calcium carbonate aqueous solution obtained by agitating the foregoing materials for four days in a ball mill is used as an aqueous phase. The average particle diameter of the calcium carbonate is measured by the laser diffraction/scattering particle diameter distribution measuring apparatus LA-700 (produced by Horiba Corp.), and it is about 0.08 μm.

| | |
|---|---|
| Carboxymethyl cellulose (Cellogen BSH, produced by Dai-ichi Kogyo Seiyaku Co., Ltd.) | 2 parts |
| Pure water | 98 parts |

A carboxymethyl cellulose aqueous solution obtained by mixing the foregoing materials in a ball mill is used as an aqueous phase.

Preparation of Spherical Particles

| | |
|---|---|
| Oily phase | 55 parts |
| Aqueous phase (calcium carbonate aqueous solution) | 15 parts |
| Aqueous phase (carboxymethyl cellulose aqueous solution) | 30 parts |

The foregoing materials are put in a colloid mill (produced by Nippon Seiki Co., Ltd.) and subjected to emulsification therein at a gap distance of 1.5 mm, a rotation rate of 9,400 rotations per minute for 40 minutes. The resulting emulsion is put in a rotary evaporator, and the solvent is removed at room temperature under a reduced pressure of 30 mmHg over 3 hours. 12N hydrochloric acid is then added thereto until the pH becomes 2, so as to remove calcium carbonate from the surface of the toner. Thereafter, a 10N sodium hydroxide aqueous solution is added thereto until the pH becomes 10, and agitation is further continued for 1 hour using a stirrer in an ultrasonic scrubber. Centrifugal sedimentation is conducted, and washing is carried out by replacing the supernatant three times, followed by drying, to take out the spherical particles. The particles have an average particle diameter of 4.1 μm and a shape factor of 112.

External Addition Treatment

To 100 parts of the spherical particles, 1.2 parts of rutile titanium oxide (particle diameter: 20 nm, n-decyltrimethoxysilane treatment) and 1.8 parts of silica formed by a gas phase oxidation process (particle diameter: 40 nm, HMDS treatment) are blended in a Henschel mixer at a peripheral speed of 35 m/s for 20 minutes, and coarse particles are removed by using a sieve of 45 μm-mesh, so as to obtain spherical colored particles C.

Production of Spherical Colored Particles D

Preparation of Spherical Particles

| | |
|---|---|
| Styrene-n-butyl acrylate copolymer (monomer ratio: 8/2, Tg: 58° C., weight average molecular weight Mw: 11,500) | 100 parts |
| Carnauba wax (melting point: 81° C.) | 7 parts |
| Magenta pigment (C.I. Pigment Red 57) | 8 parts |

The foregoing composition is subjected to melt kneading in an extruder, and particles having an average particle diameter of 7.4 μm are obtained through pulverization and classification. The resulting particles are further subjected to circulation in a 90° C. atmosphere by using a hot air treating apparatus to carry out a spherical treatment. The resulting particles have a D50 value of 7.0 μm and an average shape factor $ML^2/A$ of 120.

External Addition Treatment

To 100 parts of the spherical particles, 1.0 parts of rutile titanium oxide (particle diameter: 20 nm, n-decyltrimethoxysilane treatment) and 1.6 parts of silica formed by a gas phase oxidation process (particle diameter: 50 nm, silicone oil treatment) are blended in a Henschel mixer at a peripheral speed of 35 n/s for 15 minutes, and coarse particles are removed by using a sieve of 45 μm-mesh, so as to obtain spherical colored particles D.

Production of Irregular-shaped Colored Particles E

Preparation of Resin Fine Particle Dispersion

| | |
|---|---|
| Styrene | 330 g |
| n-Butyl acrylate | 70 g |
| Acrylic acid | 8 g |
| Dodecanethiol | 12 g |
| Carbon tetrabromide | 4 g |

A solution formed by dissolving the foregoing components is dispersed and emulsified in a solution formed by dissolving 10 g of a nonionic surface active agent (Nonipole 400, produced by Sanyo Chemicals Co., Ltd.) and 10 g of an anionic surface active agent (Neogen SC, produced by Daiichi Kogyo Seiyaku Co., Ltd.) in 550 g of ion exchanged water in a flask, and 50 g of ion exchanged water having 4 g of ammonium persulfate dissolved therein is added thereto over 10 minutes under slowly mixing, followed by exchanging with nitrogen. The contents of the flask are heated to 70° C. over an oil bath under stirring, followed by continuing the emulsion polymerization for 5 hours. Thus, an anionic resin dispersion having a mean diameter of 170 nm, a glass transition point of 54° C. and a weight average molecular weight Mw of 20,000 is obtained. The dispersion has a solid concentration of 40% by weight.

Preparation of Colorant Dispersion

| | |
|---|---|
| Phthalocynanine pigment (PV Fast Blue) | 100 g |
| Nonionic surface active agent (Nonipole 400) | 5 g |
| Ion exchanged water | 200 g |

The foregoing components are mixed and dissolved, and the resulting mixture is dispersed in a rotor-stator type homogenizer (Ultra-Turrax, produced by IKA Japan Co., Ltd.) for 10 minutes and further dispersed in an ultrasonic homogenizer for 5 minutes, so as to obtain a cyan pigment colorant dispersion having a mean particle diameter of 150 nm.

Preparation of Releasing Agent Dispersion

| | |
|---|---|
| Paraffin wax (HNP0190, produced by Nippon Seiro Co., Ltd., melting point: 85° C.) | 100 g |
| Cationic surface active agent (Sanisol B50, produced by Kao Corp.) | 5 g |
| Ion exchanged water | 240 g |

The foregoing components are mixed and dispersed in a stainless steel round flask by a homogenizer (Ultra-Turrax T50, produced by IKA Japan Co., Ltd.) for 10 minutes, and thereafter it is subjected to a dispersion treatment by a pressure discharge type homogenizer, so as to prepare a wax dispersion having wax particles having an average particle diameter of 550 nm dispersed therein.

Preparation of Aggegated Particles

| | |
|---|---|
| Resin dispersion | 200 parts |
| Colorant dispersion | 13 parts |
| Releasing agent dispersion | 40 parts |

-continued

| | |
|---|---|
| Polyaluminum chloride (PAC 100W, produced by Asada Chemical Industries, Ltd.) | 1.8 parts |
| Ion exchanged water | 600 parts |

The foregoing components are mixed and dispersed in a stainless steel round flask by Ultra-Turrax T50, and thereafter it is heated to 48° C. over a heating oil bath under stirring the contents of the flask. After maintaining at 48° C. for 60 minutes, the formation of aggregated particles having a diameter of about 7.0 μm is confirmed by an optical microscope. 30 parts of the resin composite dispersion is gradually added thereto, and the temperature of the heating oil bath is increased to 50° C., followed by maintaining for 30 minutes. The formation of aggregated particles having a diameter of about 7.5 μm is confirmed by an optical microscope. And the temperature is further increased to 53° C., followed by maintaining for 1 hour. Substantially no change of the average dispersion particle diameter is observed. Thereafter, 2 g of Neogen SC is added thereto, and the stainless steel flask is sealed. The contents of the flask is heated to 95° C. under continued stirring using a magnetic seal, followed by maintaining for 3 hours. After cooling, the particles are filtered off and sufficiently washed with ion exchanged water, followed by subjecting to freeze drying, so as to obtain aggregated particles. The particles have an average particle diameter of 6.3 μm and a shape factor of 136.

External Addition Treatment

To 100 parts of the aggregated particles, 1.0 part of rutile titanium oxide (particle diameter: 20 nm, n-decyltrimethoxysilane treatment) and 1.8 parts of silica formed by a gas phase oxidation process (particle diameter: 50 nm, silicone oil treatment) are blended in a Henschel mixer at a peripheral speed of 30 m/s for 15 minutes, and coarse particles are removed by using a sieve of 45 μm-mesh, so as to obtain irregular-shaped colored particles E.

Production of Irregular-shaped Non-colored Particles a

| | |
|---|---|
| Styrene-n-butyl acrylate copolymer (monomer ratio: 8/2, Tg: 58° C., weight average molecular weight Mw: 11,500) | 100 parts |
| Zinc stearate (ZNS-P, produced by Asahi Denka Kogyo Co., Ltd.) | 20 parts |

The foregoing composition is subjected to melt kneading in an extruder, and particles having an average particle diameter of 4.5 μm are produced through a pulverization step. The particles have a shape factor of 142. To 100 parts of the particles, 2 parts of spherical monodisperse silica (silica sol obtained by a sol-gel process is subjected to an HMDS treatment, and then subjected to drying and pulverization, Wadell conglobation degree Ψ: 0.95, particle diameter D50: 120 nm, particle size standard deviation: 22 nm) is blended in a Henschel mixer at a peripheral speed of 35 m/s for 20 minutes, and coarse particles are removed by using a sieve of 45 μm-mesh, so as to obtain irregular-shaped non-colored particles a.

Production of Irregular-shaped Non-colored Particles b

Production of Resin Fine Particle Dispersion 370 g of styrene, 30 g of n-butyl acrylate, 8 g of acrylic acid, 24 g of dodecanethiol and 4 g of carbon tetrabromide are mixed and dissolved, and the solution is emulsion-polymerized in a solution formed by dissolving 6 g of a nonionic surface active agent (Nonipole 400, produced by Sanyo Chemicals Co., Ltd.) and 10 g of an anionic surface active agent (Neogen SC, produced by Daiichi Kogyo Seiyaku Co., Ltd.) in 550 g of ion exchanged water in a flask, to which 50 g of ion exchanged water having 4 g of ammonium persulfate dissolved therein is added over 10 minutes under slowly mixing. After replacing with nitrogen, the content of the flask is heated to 70° C. over an oil bath, and the emulsion polymerization is continued for 5 hours. As a result, a resin fine particle dispersion having an average particle diameter of 150 nm, a glass transition point Tg of 58° C. and a weight average molecular weight Mw of 11,500 is obtained. The solid content of the dispersion is 40% by weight.

Production of Resin Particles

To 260 g of the resin fine particle dispersion, 1.8 g of polyaluminum chloride (PAC100W, produced by Asada Chemical Industries, Ltd.) is added, and 900 g of ion exchanged water is further added thereto. The mixture is mixed and dispersed in a stainless steel round flask by using Ultra-Turrax T50 (produced by IKA Japan Co., Ltd.), and then heated to 40° C. under stirring in the flask over a heating oil bath. Thereafter, after maintaining 30 minutes, the particle size is measured by a Coulter Counter (produced by Beckman Coulter, Inc.), and it is 3.1 μm. Thereafter, a 0.1N sodium hydroxide aqueous solution is added to the dispersion to adjust the pH of the system to 7, and then the system is heated to 75° C. under continuous stirring, followed by maintaining for 30 minutes. The resin particles are filtered off and washed with ion exchanged water four times, followed by subjecting to freeze drying. The resin particles have an average particle diameter of 3.2 μm and an average value of a shape factor $ML^2/A$ of 138.

External Addition Treatment

To 100 parts of the resin particles, 2 parts of spherical monodisperse silica (silica sol obtained by a sol-gel process is subjected to an HMDS treatment, and then subjected to drying and pulverization, Wadell conglobation degree Ψ: 0.92, particle diameter D50: 137 nm, particle size standard deviation: 25 nm) is blended in a Henschel mixer at a peripheral speed of 35 m/s for 20 minutes, and coarse particles are removed by using a sieve of 45 μm-mesh, so as to obtain irregular-shaped non-colored particles b.

Production of Irregular-shaped Non-colored Particles c

Irregular-shaped non-colored particles c are obtained in the same manner as the irregular-shaped non-colored particles b except that the external addition treatment of the spherical monodisperse silica is not carried out.

Production of Irregular-shaped Non-colored Particles d

| | |
|---|---|
| Styrene-n-butyl acrylate copolymer (monomer ratio: 8/2, Tg: 58° C., weight average molecular weight Mw: 11,500) | 100 parts |
| Positive charge controlling agent (P51, produced by Orient Chemical Industries, Ltd.) | 1.5 parts |

The foregoing composition is subjected to melt kneading in an extruder, and particles having an average particle diameter of 5.4 μm are produced through a pulverization step. The particles have a shape factor of 145. The particles are designated as irregular-shaped non-colored particles d.

Production of Irregular-shaped Non-colored Particles e

| | |
|---|---|
| Styrene-n-butyl acrylate copolymer (monomer ratio: 8/2, Tg: 58° C., weight average molecular weight Mw: 11,500) | 100 parts |
| Zinc oxide fine particles (average particle diameter: 20 nm) | 35 parts |

The foregoing composition is subjected to melt kneading in an extruder, and particles having an average particle diameter of 3.5 μm are produced through a pulverization step. The particles have a shape factor of 137. The particles are designated as irregular-shaped non-colored particles e.

Production of Irregular-shaped Non-colored Particles f 100 parts of a linear polyester resin (combination of an ethylene oxide adduct of bisphenol A and terephthalic acid, Tg: 65° C., Mn: 4,000, Mw: 10,000) is subjected to melt kneading in an extruder, and particles having an average particle diameter of 4.2 μm are obtained through a pulverization step. The particles have a shape factor of 133. The particles are designated as irregular-shaped non-colored particles f.

Production of Spherical Non-colored Particles g

Production of Resin Fine Particle Dispersion 370 g of styrene, 30 g of n-butyl acrylate, 8 g of acrylic acid, 24 g of dodecanethiol and 4 g of carbon tetrabromide are mixed and dissolved, and the solution is emulsion-polymerized in a solution formed by dissolving 6 g of a nonionic surface active agent (Nonipole 400, produced by Sanyo Chemicals Co., Ltd.) and 10 g of an anionic surface active agent (Neogen SC, produced by Daiichi Kogyo Seiyaku Co., Ltd.) in 550 g of ion exchanged water in a flask, to which 50 g of ion exchanged water having 4 g of ammonium persulfate dissolved therein is added over 10 minutes under slowly mixing. After replacing with nitrogen, the content of the flask is heated to 70° C. over an oil bath, and the emulsion polymerization is continued for 5 hours. As a result, a resin fine particle dispersion having an average particle diameter of 150 nm, a glass transition point Tg of 58° C. and a weight average molecular weight Mw of 11,500 is obtained. The solid content of the dispersion is 40% by weight.

Production of Resin Particles

To 260 g of the resin fine particle dispersion, 1.8 g of polyaluminum chloride (PAC100W, produced by Asada Chemical Industries, Ltd.) is added, and 900 g of ion exchanged water is further added thereto. The mixture is mixed and dispersed in a stainless steel round flask by using Ultra-Turrax T50 (produced by IKA Japan Co., Ltd.), and then heated to 40° C. under stirring in the flask over a heating oil bath. Thereafter, after maintaining 30 minutes, the particle size is measured by a Coulter Counter (produced by Beckman Coulter, Inc.), and it is 3.4 μm. Thereafter, a 0.1N sodium hydroxide aqueous solution is added to the dispersion to adjust the pH of the system to 7, and then the system is heated to 75° C. under continuous stirring, followed by maintaining for 30 minutes. A 1N sodium hydroxide solution is added to the dispersion containing the aggregated particles to adjust the pH of the system to 5.0. Thereafter, the stainless steel flask is sealed, and the contents of the flask is heated to 95° C. under continued stirring using a magnetic seal, followed by maintaining for 6 hours. The resulting resin particles are filtered off and washed with ion exchanged water four times, followed by subjecting to freeze drying. The resin particles have an average particle diameter of 3.1 μm and an average value of a shape factor $ML^2/A$ of 114.

External Addition Treatment

To 100 parts of the resin particles, 2 parts of spherical monodisperse silica (silica sol obtained by a sol-gel process is subjected to an HMDS treatment, and then subjected to drying and pulverization, Wadell conglobation degree Ψ: 0.92, particle diameter D50: 137 nm, particle size standard deviation: 25 nm) is blended in a Henschel mixer at a peripheral speed of 35 m/s for 20 minutes, and coarse particles are removed by using a sieve of 45 μm-mesh, so as to obtain spherical non-colored particles g.

Production of Carrier Particles

| | |
|---|---|
| Mn-Mg-Sr series ferrite particles (average particle diameter: 40 μm) | 100 parts |
| Toluene | 14 parts |
| Styrene-methyl methacrylate copolymer (copolymerization ratio: 2/8, Mw: 100,000) | 2.0 parts |
| Carbon black (R330R, produced by Cabot Inc.) | 0.12 part |
| Crosslinked melamine resin particles (volume average particle diameter: 0.3 μm, insoluble in toluene) | 0.3 part |

The foregoing components other than the ferrite particles and glass beads (diameter: 1 mm, the same amount as toluene) are agitated in a sand mill produced by Kansai Patent Co. at 1,200 rpm for 30 minutes, so as to form a resin coating layer forming solution. The resin coating layer forming solution and the ferrite particles are placed in a vacuum deaeration type kneader and agitated at a temperature of 60° C. maintained for 10 minutes. Thereafter, toluene is distilled off under reduced pressure to form a resin coating layer. The product is sieved with 75 μm-mesh to form carrier particles.

Example 1

100 parts of the spherical colored particles A and 0.5 part of the irregular-shaped non-colored particles a are blended in a Henschel mixer at a peripheral speed of 20 m/s for 2 minutes, and coarse particles are removed by using a sieve of 45 μm-mesh, so as to obtain a toner. 100 parts of the carrier and 7 parts of the toner are agitated in a V-blender at 40 rpm for 20 minutes, followed by sieving with 212 μm-mesh, so as to obtain a developer.

Example 2

100 parts of the spherical colored particles A and 0.5 part of the irregular-shaped non-colored particles b are blended in a Henschel mixer at a peripheral speed of 20 m/s for 2 minutes, and coarse particles are removed by using a sieve of 45 μm-mesh, so as to obtain a toner. 100 parts of the carrier and 7 parts of the toner are agitated in a V-blender at 40 rpm for 20 minutes, followed by sieving with 212 μm-mesh, so as to obtain a developer.

Example 3

100 parts of the spherical colored particles A and 1.0 part of the irregular-shaped non-colored particles c are blended in a Henschel mixer at a peripheral speed of 20 m/s for 2 minutes, and coarse particles are removed by using a sieve of 45 μm-mesh, so as to obtain a toner. 100 parts of the carrier and 7 parts of the toner are agitated in a V-blender at 40 rpm for 20 minutes, followed by sieving with 212 μm-mesh, so as to obtain a developer.

Example 4

100 parts of the spherical colored particles B and 0.08 part of the irregular-shaped non-colored particles c are blended in a Henschel mixer at a peripheral speed of 20 m/s for 2 minutes, and coarse particles are removed by using a sieve of 45 μm-mesh, so as to obtain a toner. 100 parts of the carrier and 7 parts of the toner are agitated in a V-blender at 40 rpm for 20 minutes, followed by sieving with 212 μm-mesh, so as to obtain a developer.

Example 5

100 parts of the spherical colored particles C and 2.5 parts of the irregular-shaped non-colored particles b are blended in a Henschel mixer at a peripheral speed of 20 m/s for 2 minutes, and coarse particles are removed by using a sieve of 45 μm-mesh, so as to obtain a toner. 100 parts of the carrier and 7 parts of the toner are agitated in a V-blender at 40 rpm for 20 minutes, followed by sieving with 212 μm-mesh, so as to obtain a developer.

Example 6

100 parts of the spherical colored particles C and 1.0 part of the irregular-shaped non-colored particles d are blended in a Henschel mixer at a peripheral speed of 20 m/s for 2 minutes, and coarse particles are removed by using a sieve of 45 μm-mesh, so as to obtain a toner. 100 parts of the carrier and 7 parts of the toner are agitated in a V-blender at 40 rpm for 20 minutes, followed by sieving with 212 μm-mesh, so as to obtain a developer.

Example 7

100 parts of the spherical colored particles D and 1.0 part of the irregular-shaped non-colored particles e are blended in a Henschel mixer at a peripheral speed of 20 m/s for 2 minutes, and coarse particles are removed by using a sieve of 45 μm-mesh, so as to obtain a toner. 100 parts of the carrier and 7 parts of the toner are agitated in a V-blender at 40 rpm for 20 minutes, followed by sieving with 212 μm-mesh, so as to obtain a developer.

Comparative Example 1

100 parts of the spherical colored particles D and 0.5 part of the irregular-shaped non-colored particles f are blended in a Henschel mixer at a peripheral speed of 20 m/s for 2 minutes, and coarse particles are removed by using a sieve of 45 μm-mesh, so as to obtain a toner. 100 parts of the carrier and 7 parts of the toner are agitated in a V-blender at 40 rpm for 20 minutes, followed by sieving with 212 μm-mesh, so as to obtain a developer.

Comparative Example 2

100 parts of the spherical colored particles D and 0.5 part of the irregular-shaped non-colored particles d are blended in a Henschel mixer at a peripheral speed of 20 m/s for 2 minutes, and coarse particles are removed by using a sieve of 45 μm-mesh, so as to obtain a toner. 100 parts of the carrier and 7 parts of the toner are agitated in a V-blender at 40 rpm for 20 minutes, followed by sieving with 212 μm-mesh, so as to obtain a developer.

Comparative Example 3

100 parts of the irregular-shaped colored particles E and 0.5 part of the irregular-shaped non-colored particles a are blended in a Henschel mixer at a peripheral speed of 20 m/s for 2 minutes, and coarse particles are removed by using a sieve of 45 μm-mesh, so as to obtain a toner. 100 parts of the carrier and 7 parts of the toner are agitated in a V-blender at 40 rpm for 20 minutes, followed by sieving with 212 μm-mesh, so as to obtain a developer.

Comparative Example 4

100 parts of the spherical colored particles A and 0.5 part of the spherical non-colored particles g are blended in a Henschel mixer at a peripheral speed of 20 m/s for 2 minutes, and coarse particles are removed by using a sieve of 45 μm-mesh, so as to obtain a toner. 100 parts of the carrier and 7 parts of the toner are agitated in a V-blender at 40 rpm for 20 minutes, followed by sieving with 212 μm-mesh, so as to obtain a developer.

Evaluation

The developers of Examples and Comparative Examples are subjected to the following evaluation. The results of actual machine evaluation are shown in Table 1 below along with the characteristics of the developers of Examples and Comparative Examples. In the table, the charge distribution of the developers (particles) in the initial state (peak value Q/Ma ascribable to the spherical colored particles and a peak value Q/Mb ascribable to the irregular-shaped non-colored particles) is measured by using E-spart Analyzer (note 1). The running test at a blade linear pressure of 3.5 g/mm and the toner consuming amount and the cleaning recovering amount of the toner on the running test at 2.0 g/mm are averaged by calculation (note 2).

Evaluation of Long Term Cleaning Property and Transfer Property

The cleaning property and the transfer property are evaluated by using the developer in a modified machine of Docu Color 1250 (produced by Fuji Xerox Co., Ltd.). The modification of the machine is that the charging device is changed to an AC/DC overlaid contact charging roll. The evaluation is carried out under the following conditions. The other conditions than the following are in accordance with the standard setting of the machine for evaluation.

Environment: 20° C./50% RH

Image: A monochrome Japanese document (image density: 5%) is continuously output.

In order to evaluate the cleaning property and the transfer property, a copy of half tone on the whole area, a copy of 2 cm×2 cm solid images and a blank copy are output per 1,000 sheets.

Development: The developers of Examples and Comparative Examples are arranged at the black development position, and evaluated in monochrome.

Measurement of linear pressure of cleaning blade: Continuous output is conducted for two conditions of 2 g/mm and 3.5 g/mm.

Paper used: J Paper, A-3 size, produced by Fuji Xerox Co., Ltd.

Cleaning Property

The cleaning property is evaluated after output of the prescribed number of sheets in terms of the following grades.

A: The contact charging roll is not contaminated.

B: The contact charging roll is contaminated, which is not printed out.

C: The contact charging roll is contaminated, which is printed out.

Transfer Property

The transfer property is evaluated in terms of the following grades.

A: The proportion of the amount of the cleaning recovered toner to the total amount of the consumed toner is less than 5%.

B: The proportion of the amount of the cleaning recovered toner to the total amount of the consumed toner is 5% or more and less than 10%.

C: The proportion of the amount of the cleaning recovered toner to the total amount of the consumed toner is 10% or more, but unevenness in image density and roughness are not found in the solid image after output of 30,000 sheets.

D: The proportion of the amount of the cleaning recovered toner to the total amount of the consumed toner is 10% or more, and unevenness in image density and roughness are found in the solid image after output of 30,000 sheets.

TABLE 1

| | | | Example 1 | Example 2 | Example 3 | Example 4 | Example 5 | Example 6 | Example 7 |
|---|---|---|---|---|---|---|---|---|---|
| Shape factor of colored particles | | | 117 | 117 | 117 | 117 | 112 | 112 | 120 |
| Shape factor of non-colored particles | | | 142 | 138 | 138 | 138 | 138 | 145 | 137 |
| Average diameter of colored particles Da (μm) | | | 6.2 | 6.2 | 6.2 | 6.2 | 4.1 | 4.1 | 7.0 |
| Average diameter of non-colored particles Db (μm) | | | 4.5 | 3.2 | 3.2 | 3.2 | 3.2 | 5.4 | 3.5 |
| Q/Ma (μC/g) (note 1) | | | −40.2 | −38.3 | −37.4 | −33.1 | −62.5 | −57.0 | −29.3 |
| Q/Mb (μC/g) (note 1) | | | 12.0 | −10.4 | −16.2 | −5.2 | −8.1 | 29.0 | −10.5 |
| (Q/Mb)/(Q/Ma) | | | −0.30 | 0.27 | 0.43 | 0.16 | 0.13 | −0.51 | 0.36 |
| Db/Da | | | 0.73 | 0.52 | 0.52 | 0.52 | 0.78 | 1.32 | 0.50 |
| Mixing ratio of colored particles and non-colored particles | | | 100:0.5 | 100:0.5 | 100:1.0 | 100:0.08 | 100:2.5 | 100:1.0 | 100:1.0 |
| Addition of spherical monodisperse silica | | | Both added | both added | added only to colored particles | Added only to colored particles | added only to non-colored particles | none | none |
| Results of evaluation of cleaning maintenance property | Linear pressure of blade: 3.5 g/mm | Initial stage | A | A | A | A | A | A | A |
| | | After 5,000 sheets | A | A | A | A | A | A | A |
| | | After 10,000 sheets | A | A | A | A | A | A | A |
| | | After 20,000 sheets | A | A | A | A | A | B | B |
| | | After 30,000 sheets | A | A | A | B | A | B | B |
| | Linear pressure of blade: 2.0 g/mm | Initial stage | A | A | A | A | A | A | A |
| | | After 5,000 sheets | A | A | A | A | A | B | A |
| | | After 10,000 sheets | A | A | A | B | A | B | A |
| | | After 20,000 sheets | A | A | A | B | A | B | B |
| | | After 30,000 sheets | A | A | A | B | A | B | B |
| Transfer property after 30,000 sheets output (note 2) | | | A | A | A | A | B | B | B |
| Remarks | | | — | — | — | — | slight contamination inside machine | — | — |

| | | | Comparative Example 1 | Comparative Example 2 | Comparative Example 3 | Comparative Example 4 |
|---|---|---|---|---|---|---|
| Shape factor of colored particles | | | 120 | 120 | 136 | 117 |
| Shape factor of non-colored particles | | | 133 | 145 | 142 | 114 |
| Average diameter of colored particles Da (μm) | | | 7.0 | 7.0 | 6.3 | 6.2 |
| Average diameter of non-colored particles Db (μm) | | | 4.2 | 5.4 | 4.5 | 3.1 |
| Q/Ma (μC/g) (note 1) | | | −28.4 | −26.2 | −35.5 | −40.5 |
| Q/Mb (μC/g) (note 1) | | | −32.1 | −20.3 | 11.6 | −8.3 |
| (Q/Mb)/(Q/Ma) | | | 1.13 | −0.77 | −0.33 | 0.20 |
| Db/Da | | | 0.60 | 0.77 | 0.71 | 0.50 |
| Mixing ratio of colored particles and non-colored particles | | | 100:0.5 | 100:0.5 | 100:0.5 | 100:0.5 |
| Addition of spherical monodisperse silica | | | none | none | added only to non-colored particles | both added |
| Results of evaluation of cleaning maintenance property | Linear pressure of blade: 3.5 g/mm | Initial stage | B | A | A | B |
| | | After 5,000 sheets | B | B | A | C |
| | | After 10,000 sheets | C | B | A | C |
| | | After 20,000 sheets | C | C | A | C |
| | | After 30,000 sheets | C | C | A | C |
| | Linear pressure of blade: 2.0 g/mm | Initial stage | B | A | A | C |
| | | After 5,000 sheets | C | C | A | C |
| | | After 10,000 sheets | C | C | A | C |
| | | After 20,000 sheets | C | C | A | C |

TABLE 1-continued

| | | | | |
|---|---|---|---|---|
| After 30,000 sheets | C | C | A | C |
| Transfer property after 30,000 sheets output (note 2) | C | B | D | B |
| Remarks | — | photoreceptor or damaged after 5,000 sheets | photoreceptor or damaged after 5,000 sheets | — |

It is understood from the table that the electrophotographic developer of the invention containing the spherical colored particles and the irregular-shaped colored particles that satisfy the specific charge conditions is a developer excellent in both the transfer property and the cleaning property, and thus it maintains an image of high image quality owing to high transfer efficiency and exhibits time-lapse stability of high image quality by improvement in cleaning property.

According to the foregoing, the invention provides an electrophotographic developer and a process for forming an image that attain improvement in reliability by improvement in cleaning property and reduction in wear of a photoreceptor in a well-balanced manner without impairing high transfer efficiency and high image quality of a spherical toner.

The entire disclosure of Japanese Patent Application No. 2000-383510 filed on Dec. 18, 2000 including specification, claims, and abstract is incorporated herein by reference in its entirety.

What is claimed is:

1. An electrophotographic developer comprising a toner and a carrier, the toner containing a spherical colored particles having an average shape factor ($ML^2/A$) of about from 100 to 135 and irregular-shaped non-colored particles having a volume average particle diameter of about from 1 to 10 $\mu$m, wherein the developer has a charge distribution having a peak value Q/Ma ascribable to the spherical colored particles and a peak value Q/Mb ascribable to the irregular-shaped non-colored particles, the peak value Q/Ma and the peak value Q/Mb satisfying both the following formulae (1) and (2):

$$20\ \mu C/g \leqq |Q/Ma| \leqq 85\ \mu C/g \quad (1)$$

$$-0.7\ Q/Ma \leqq Q/Mb \leqq 0.5\ Q/Ma \quad (2).$$

2. The electrophotographic developer as claimed in claim 1, wherein the irregular-shaped non-colored particles have an average shape factor ($ML^2/A$) of about from 135 to 150.

3. The electrophotographic developer as claimed in claim 1, wherein an absolute value of the peak value Q/Ma ascribable to the spherical colored particles is about from 30 to 70 $\mu$C/g.

4. The electrophotographic developer as claimed in claim 1, wherein the peak value Q/Mb ascribable to the irregular-shaped non-colored particles is about from −0.60 Q/Ma to 0.45 Q/Ma.

5. The electrophotographic developer as claimed in claim 1, wherein the volume average particle diameter Da of the spherical colored particles and a volume average particle diameter Db of the irregular-shaped non-colored particles satisfy the following formula (3):

$$0.1\ Da \leqq Db \leqq Da \quad (3).$$

6. The electrophotographic developer as claimed in claim 5, wherein the volume average particle diameter Db of the irregular-shaped non-colored particles is about from 0.20 Da to 0.85 Da.

7. The electrophotographic developer as claimed in claim 1, wherein the toner contains the spherical colored particles and the irregular-shaped non-colored particles in a mixing ratio by weight (spherical colored particles/irregular-shaped non-colored particles) of about from 100/0.1 to 100/2.0.

8. The electrophotographic developer as claimed in claim 1, wherein the irregular-shaped non-colored particles are selectively developed in a background part of an electrostatic latent image.

9. The electrophotographic developer as claimed in claim 1, wherein the irregular-shaped non-colored particles contain a positive charge controlling agent.

10. The electrophotographic developer as claimed in claim 1, wherein the spherical colored particles and the irregular-shaped non-colored particles have a different external additive compositions.

11. The electrophotographic developer as claimed in claim 1, wherein the toner has spherical inorganic fine particles as an external additive.

12. The electrophotographic developer as claimed in claim 11, wherein the spherical inorganic fine particles have an average particle diameter of about from 80 to 300 nm.

13. The electrophotographic developer as claimed in claim 11, wherein the spherical inorganic fine particles are spherical silica obtained by a sol-gel process.

14. The electrophotographic developer as claimed in claim 1, wherein the electrophotographic developer is a developer suitable for blade cleaning.

15. A process for forming a full color image comprising the steps of: forming an electrostatic latent image on a latent image holding member; developing the latent image on the latent image holding member with a developer on a developer holding member to form a toner image; transferring the toner image to a recording material directly or indirectly; and removing a non-transferred remaining component by scraping the latent image holding member with a cleaning member, wherein the toner image is formed by using the electrophotographic developer claimed in claim 1.

16. The process for forming an image as claimed in claim 15, wherein the cleaning member removing the non-transferred remaining component is a cleaning blade.

17. The process for forming an image as claimed in claim 16, wherein the cleaning blade is a polyurethane rubber blade.

18. The process for forming an image as claimed in claim 15, wherein the transferring step comprises the steps of: forming the full color image by accumulating toner images of four colors of cyan, magenta, yellow and black on an intermediate transfer material, and then transferring the full color image to the recording material.

* * * * *